US008401209B2

(12) United States Patent
Beard

(10) Patent No.: US 8,401,209 B2
(45) Date of Patent: Mar. 19, 2013

(54) MICROPHONE HAVING DIAPHRAGM RING WITH INCREASED STABILITY

(75) Inventor: John Beard, Chicago, IL (US)

(73) Assignee: Knowles Electronics, LLC, Itasca, IL (US)

( * ) Notice: Subject to any disclaimer, the term of this patent is extended or adjusted under 35 U.S.C. 154(b) by 219 days.

(21) Appl. No.: 12/765,474

(22) Filed: Apr. 22, 2010

(65) Prior Publication Data

US 2010/0272296 A1 Oct. 28, 2010

Related U.S. Application Data

(60) Provisional application No. 61/172,053, filed on Apr. 23, 2009.

(51) Int. Cl.
*H04R 25/00* (2006.01)

(52) U.S. Cl. ..... 381/184; 381/185; 381/186

(58) Field of Classification Search ..... 381/184, 381/186

See application file for complete search history.

(56) References Cited

U.S. PATENT DOCUMENTS

2002/0168076 A1* 11/2002 Collins ..... 381/355
2002/0172389 A1 11/2002 Pavlovic
2005/0276429 A1* 12/2005 Collins ..... 381/174
2006/0177085 A1* 8/2006 Izuchi et al. ..... 381/369
2007/0242847 A1* 10/2007 Gorelik et al. ..... 381/355
2008/0232631 A1* 9/2008 Loeppert ..... 381/361
2010/0061572 A1* 3/2010 Hibbing ..... 381/174
2011/0038502 A1* 2/2011 Shun Shiu et al. ..... 381/355

FOREIGN PATENT DOCUMENTS

JP 2005-057775 A 3/2005
JP 2006121597 A * 5/2006

OTHER PUBLICATIONS

International Search Report and Written Opinion for PCT/US2010/032065, dated Dec. 6, 2010.

* cited by examiner

*Primary Examiner* — Mohamad Musleh
*Assistant Examiner* — Ronald Hinson
(74) *Attorney, Agent, or Firm* — Fitch, Even, Tabin & Flannery, LLP

(57) ABSTRACT

A microphone includes a housing; a back volume within the housing; a diaphragm within the housing; a backplate attached to the housing; and a diaphragm ring connected to the diaphragm. The diaphragm ring has a body defined by an outer perimeter and at least a first inner perimeter and a second inner perimeter adjacent the first inner perimeter. The first inner perimeter is adjacent to a top surface of the diaphragm ring. The second inner perimeter is adjacent to the bottom surface of the diaphragm ring. The second inner perimeter is smaller than the first inner perimeter.

6 Claims, 5 Drawing Sheets

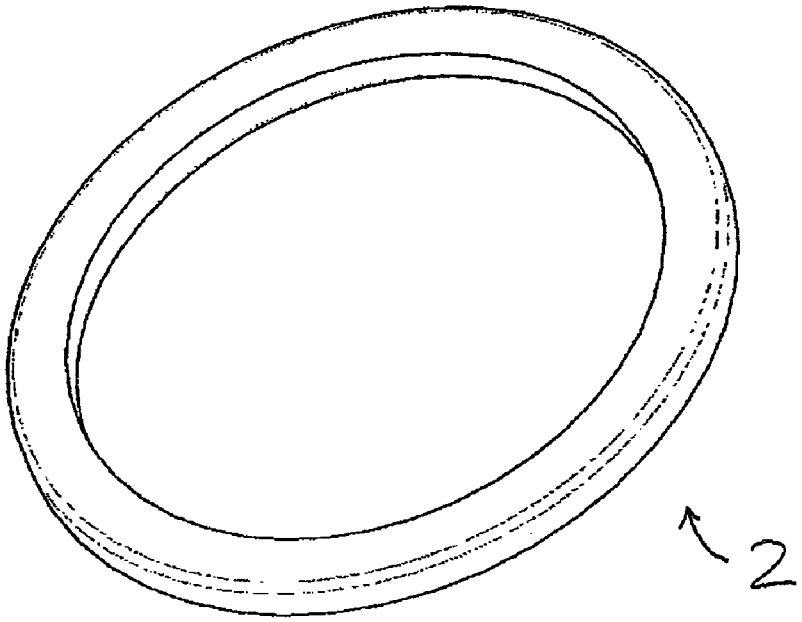
FIG. 1 – PRIOR ART
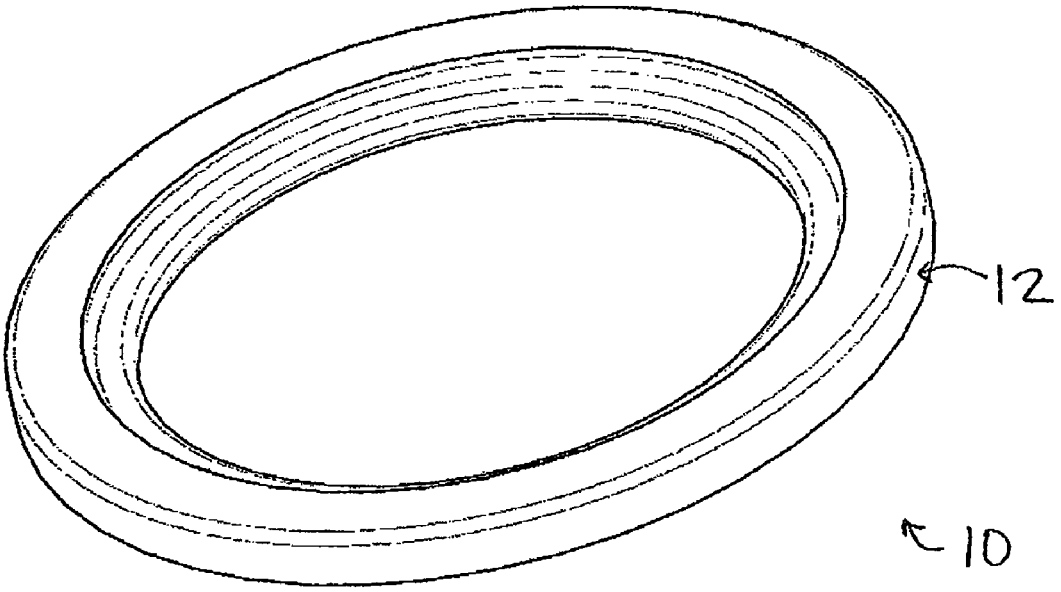
FIG. 2

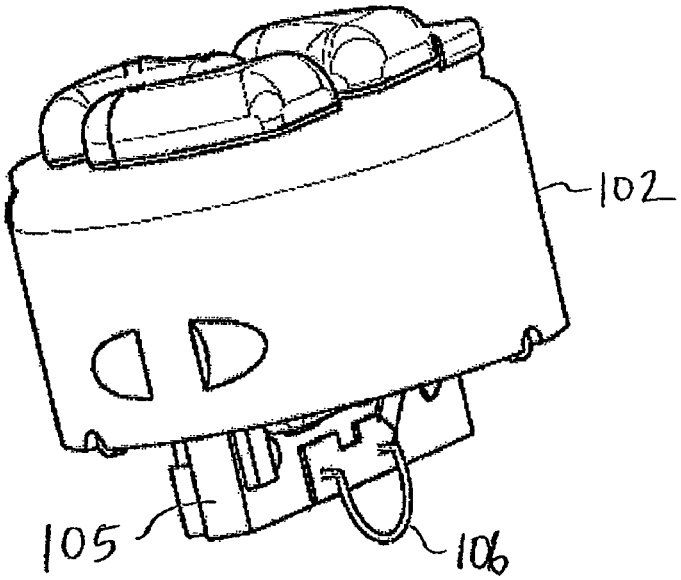
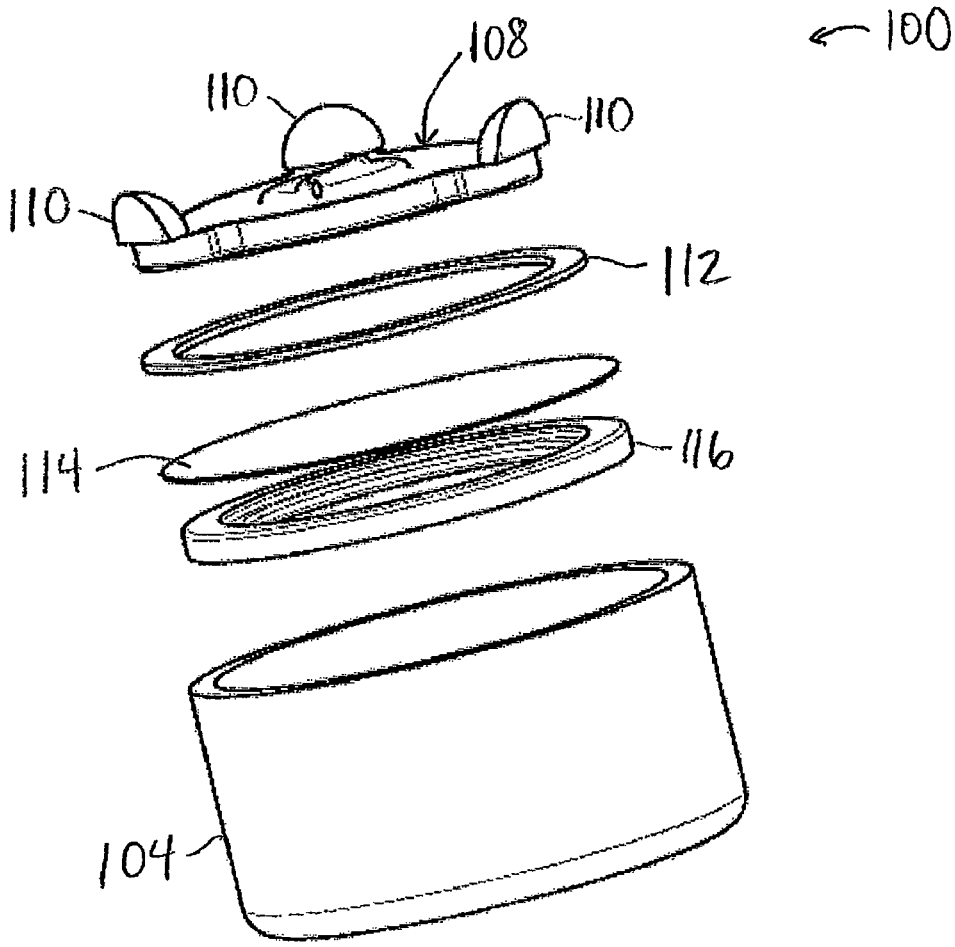
FIG. 5

MICROPHONE HAVING DIAPHRAGM RING WITH INCREASED STABILITY

CROSS REFERENCE TO RELATED APPLICATION

This patent claims benefit under 35 U.S.C. §119 (e) to U.S. Provisional Application No. 61/172,053 entitled "Microphone Having Diaphragm Ring With Increased Stability" filed Apr. 23, 2009 having the content of which is incorporated herein by reference in its entirety.

TECHNICAL FIELD

This patent application relates to a microphone having a diaphragm ring having dimensions which provide stability against forces which can occur due to ambient conditions.

BACKGROUND OF THE INVENTION

The basic structure of a microphone is generally well known and includes a diaphragm which vibrates in response to changes in acoustic pressure. The diaphragm is a thin polymer film which needs to be held under a certain amount of tension in order to provide a restoring force to move the diaphragm back towards the ring after it has been deflected. The diaphragm is typically attached to a ring 2, as illustrated in FIG. 1, within the microphone in order to provide the necessary tension. The deflection of the diaphragm in response to an acoustic pressure is inversely proportional to the tension. The output of the microphone is directly proportional to the deflection of the diaphragm. Therefore, the tension affects the sensitivity of the microphone. The function of the support ring is to provide a means of indefinitely maintaining a constant tension in the diaphragm.

The diaphragm film is fastened to the support ring at its perimeter, normally with adhesive. The support ring must provide adequate surface area for this bond such that the bond strength is sufficient to resist the tension in the diaphragm. The diaphragm has an area interior to the ring which is unsupported and free to move in response to acoustic pressure. In general, the microphone assembly is designed to maximize this area.

The diaphragm support ring is generally fastened to the microphone housing, thereby creating a sealed volume. The fastening is generally accomplished by adhesive, which forms a layer between the relatively rigid microphone housing and the diaphragm support ring. In some cases, the adhesive can react to changes in ambient conditions (temperature/humidity) by swelling or shrinking. The shrinking or swelling of adhesive can generate forces which push or pull on the diaphragm support ring. The support ring can be distorted or deflected by this stress. If the support ring is distorted it can result in a change in the diaphragm tension, which would be reflected in an undesirable and/or unpredictable change in the microphone's sensitivity.

A need, therefore, exists for a microphone assembly utilizing a ring which provides improved stability.

BRIEF DESCRIPTION OF THE DRAWINGS

For a more complete understanding of the disclosure, reference should be made to the following detailed description and accompanying drawings wherein:

FIG. 1 is a perspective view of a prior art ring used for prior art microphones;

FIG. 2 is a perspective view of a ring used in a microphone assembly in an embodiment of the present invention;

FIG. 5 is an exploded view of a microphone assembly in an embodiment of the present invention;

Figure 3:
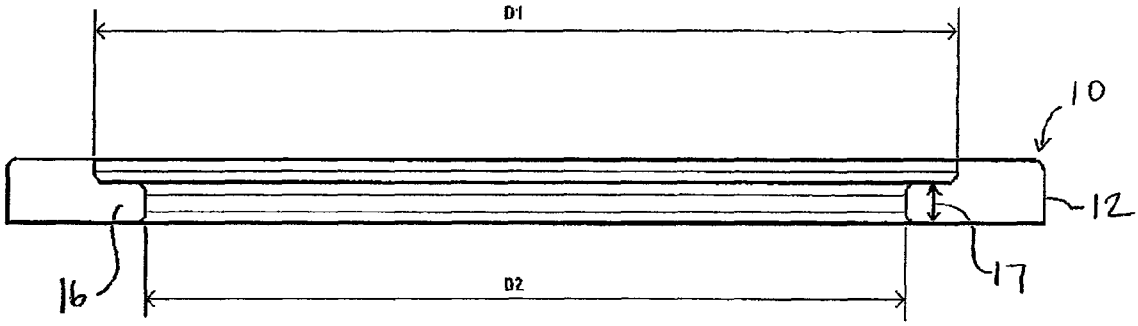
FIG. 3 is a side cross-sectional view of the ring of FIG. 2.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

While the present disclosure is susceptible to various modifications and alternative forms, certain embodiments are shown by way of example in the drawings and these embodiments will be described in detail herein. It will be understood, however, that this disclosure is not intended to limit the invention to the particular forms described, but to the contrary, the invention is intended to cover all modifications, alternatives, and equivalents falling within the spirit and scope of the invention defined by the appended claims.

The present invention generally relates to a microphone assembly utilizing a diaphragm support ring with increased stiffness or rigidity over previous designs. The benefit of increased stiffness or rigidity is that the structure is more resistant to pushing or pulling forces caused by reaction of adhesive to ambient conditions. Thus, the sensitivity of the microphone is more stable. Increased stiffness is achieved by having a portion of the ring extending inwards. However, this portion is spaced away from the diaphragm so as not to interfere with vibration of the diaphragm.

In many of these embodiments, a microphone includes a housing; a back volume within the housing; a diaphragm within the housing; a backplate attached to the housing; and a diaphragm ring connected to the diaphragm. The diaphragm ring has a body defined by an outer perimeter and at least a first inner perimeter and a second inner perimeter adjacent the first inner perimeter. The first inner perimeter is adjacent to a top surface of the diaphragm ring. The second inner perimeter is adjacent to the bottom surface of the diaphragm ring. The second inner perimeter is smaller than the first inner perimeter.

In some of these examples, the diaphragm ring is integrally formed. In other examples, the first inner perimeter and the second perimeter are provided by two separate diaphragm ring portions which form the diaphragm ring.

In some of these embodiments, a difference between the first inner perimeter and the second inner perimeter provides a stepped portion of the diaphragm ring. In other examples, a space exists between the second inner perimeter and the diaphragm. In still other examples, a taper exists between the top surface and the bottom surface.

Figure 4:
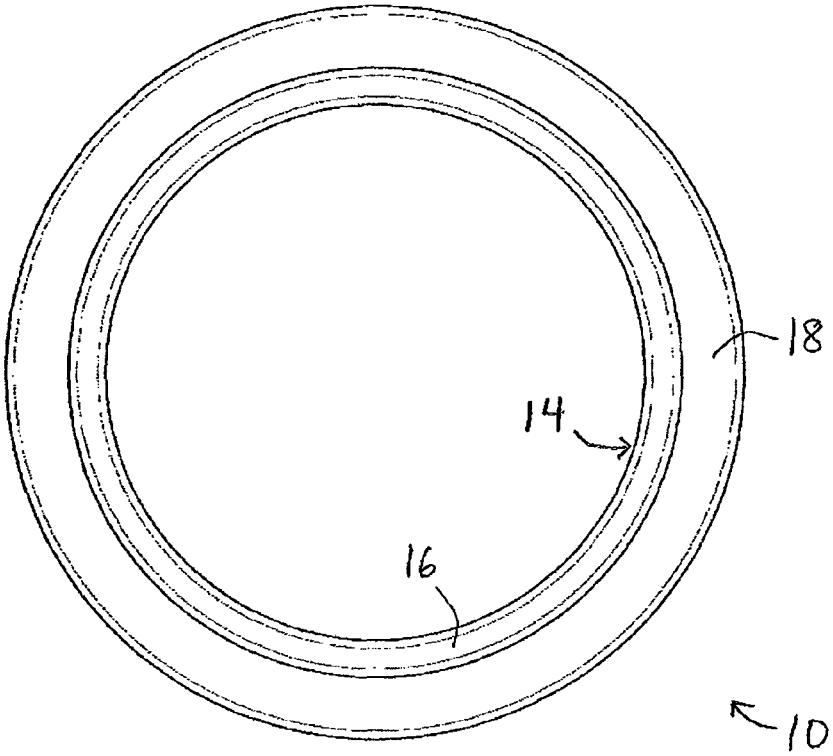
FIG. 4 is a top plan view of the ring of FIG. 2.

FIG. 2 illustrates a ring 10 in an embodiment of the present invention. The ring 10 may be constructed from metal, plastic or other materials. As illustrated, the ring 10 has a substantially circular shape; however, the ring 10 could be, for example, rectangular in shape or any other shape contemplated by those skilled in the art. The ring has an outer perimeter 12 and an inner perimeter 14. Located at the inner perimeter 14 is a step 16 which may be created via integral formation; attachment of another ring of lesser dimension than the ring 10; or other method contemplated by those of skill in the art. Placement of the step 16 within the inner perimeter 14 may provide an inner perimeter 14 having different inner diameters, as shown in FIG. 3. More specifically, the inner perimeter 14 has a first diameter D1 at a first section and a second diameter D2 at a second section as a result of the step 16. The diameter D1 may be greater than the diameter D2. A height 17 of the step 16 may be determined by the specific application as well as size requirements for that application. FIG. 4 illustrates a top plan view of the ring 10 whereby a surface 18 and the inner perimeter 14 are shown.

The ring 10 may be implemented within a microphone assembly 100 such as that seen in FIG. 5. The microphone assembly 100 has a first cup 102 and a second cup 104 which, together, form a housing. Positioned within the first cup 102 is a circuit 105 which may provide many of the functions demonstrated in conventional microphones, such as, for example, impedance conversion, amplification and filtering. The circuit 105 may have a wire 106 which connects to a backplate 108. Adhesive 110 may be provided to attach the backplate 108 to the first cup 102. A spacer 112 may be provided between the backplate 108 and a diaphragm 114 attached to a ring 116 having a structure similar to the ring 10 described above.

Figure 6:
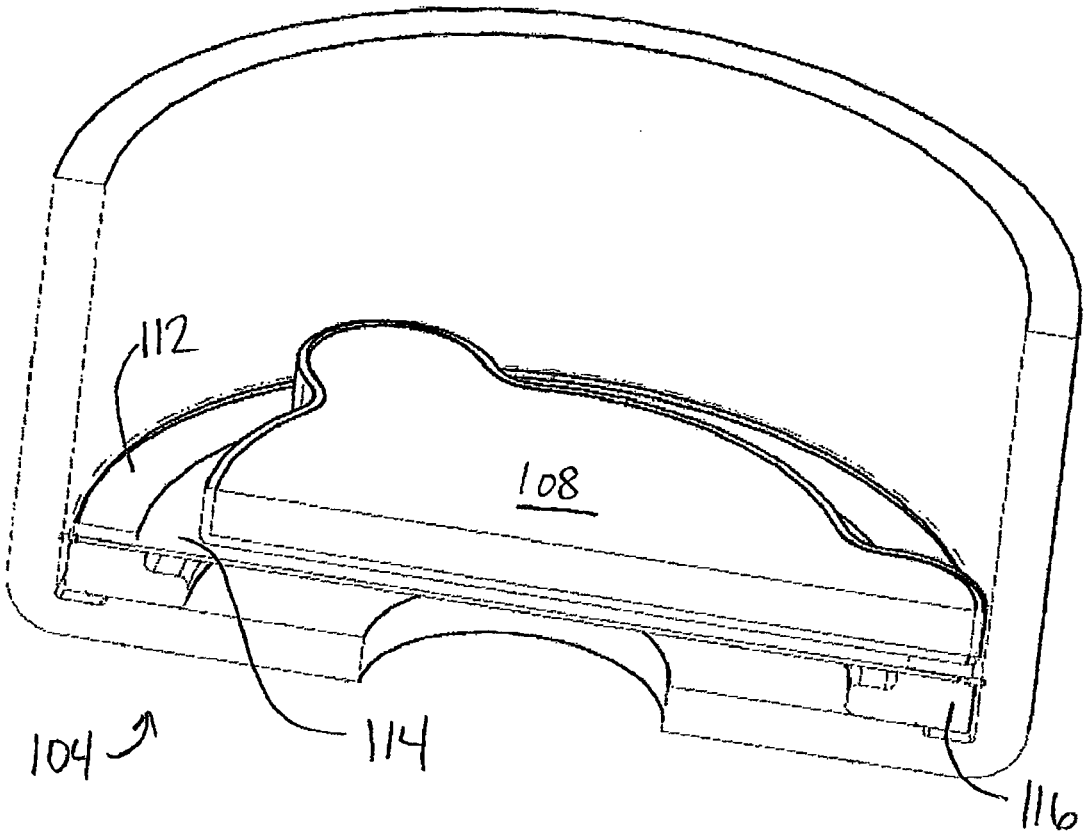
FIG. 6 is a perspective cross-sectional view of a motor-cup assembly in an embodiment of the present invention.

FIG. 6 provides an isolated, cross-sectional view of the cup 104 with the backplate 108, spacer 112, diaphragm 114 and ring 116 positioned within the cup 104 (i.e., an assembled state). The diaphragm 114 is a lightweight film which is fastened with adhesive (not shown in FIG. 6) to the diaphragm ring 116. At the time that the diaphragm 114 is attached to the diaphragm ring 116, the diaphragm 114 is under a controlled amount of tension. The diaphragm ring 116 is fastened with adhesive (not shown) to the cup 104.

Figure 7:
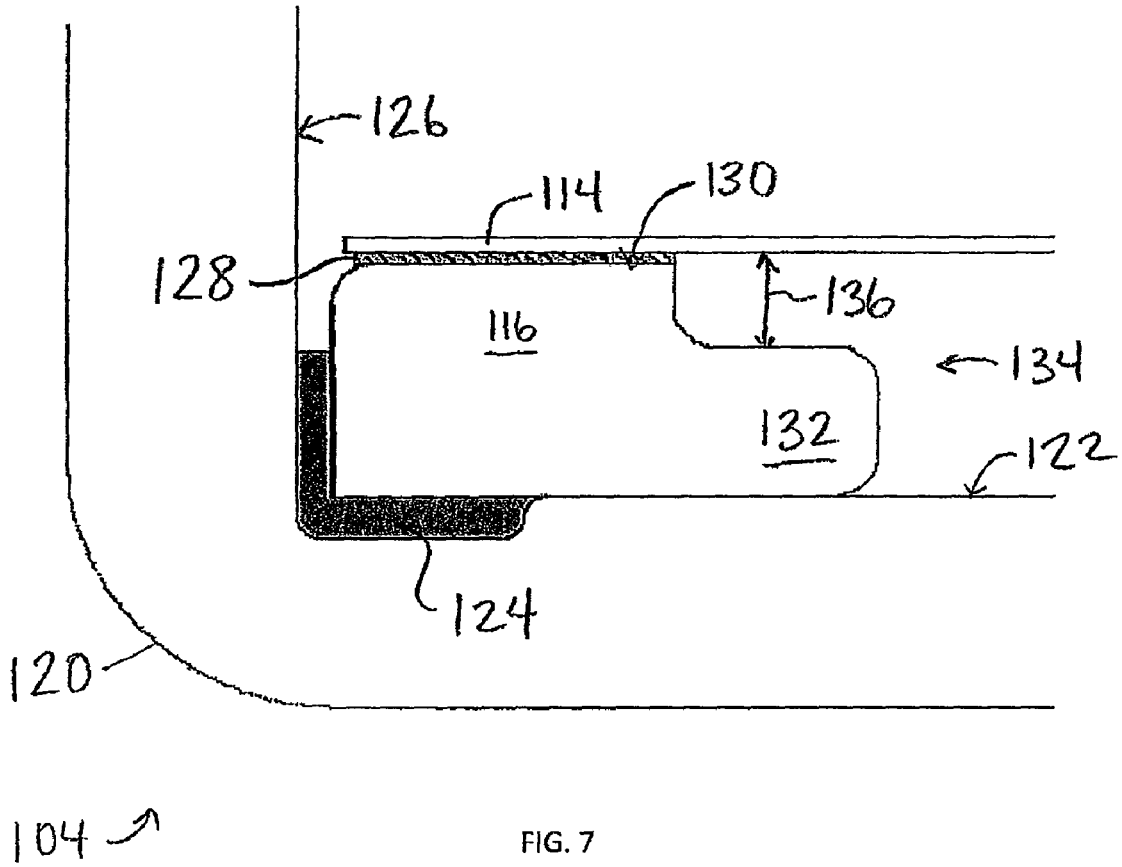
FIG. 7 is an isolated view of contact points between a diaphragm, ring, and adhesive in a microphone assembly, in an embodiment of the present invention.

FIG. 7 illustrates an isolated view of a corner section 120 of the cup 104. The ring 116 is seen resting on a surface 122 of the cup 104. A layer of adhesive 124 is positioned between the ring 116 and a wall 126; and the ring 116 and the surface 122. The adhesive 124 secures the ring 116 in place. A layer of adhesive 128 is provided to secure the diaphragm 114 to a surface 130 of the ring 116. As shown, a step 132 is formed within an inner perimeter 134 of the ring 116. The step 132 is sized to allow a space 136 between the diaphragm 114 and the step 132 so as not to interfere with vibration of the diaphragm 114.

It is important to note that the disclosure above should not be limited to embodiments in which adhesive is used to attach the ring 116 to the cup 104. Other methods of attachment are contemplated as well, such as, for example, welding. The step portion of the ring 116 provides greater resistance to the pushing or pulling forces which occur due to ambient conditions. This enables greater stability in the tension on the diaphragm 114.

Figure 8:
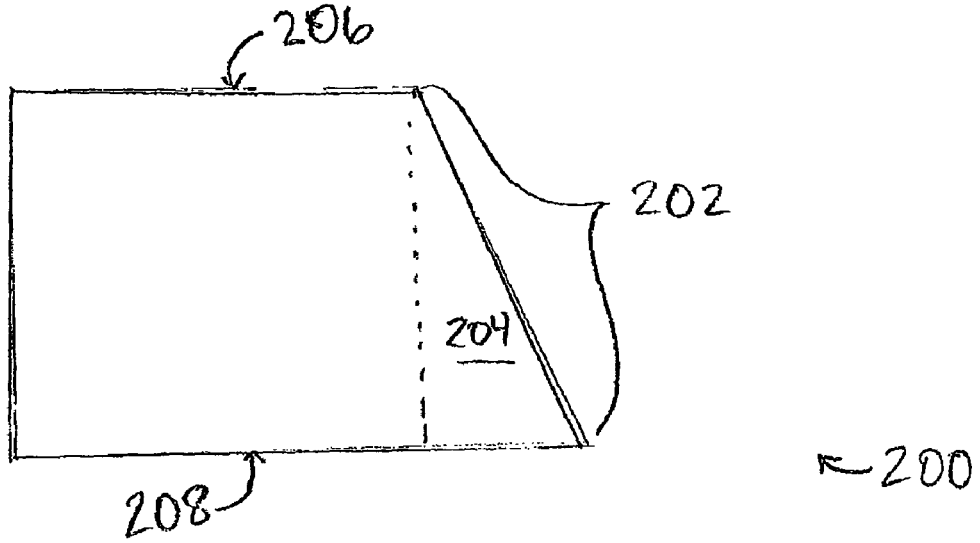
FIG. 8 is an isolated cross-sectional view of a ring in an embodiment of the present invention.

In addition, it is important to note that the shape of the step should not be limited to that provided in FIGS. 2-7. As shown in FIG. 8, a step 204 of a ring 200 may have a section 202 shaped with a gradient, or taper effect, beginning from a top surface 206 of the ring to a bottom surface 208, providing, in essence, a trapezoidal-like shape. In another embodiment, there may be a combination of a pronounced step, having one or more sections, with a gradient or taper effect in a separate section. A pronounced step, such as those described above in FIGS. 2-7, may be desirable to more clearly define the diameter D1. In essence, the present invention provides a step whereby an inner perimeter of the ring has at least two or more sections having two or more different diameters, from a top surface to a bottom surface of the ring.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A microphone comprising:

a. a housing;

b. a back volume within the housing;

c. a diaphragm within the housing;

d. a backplate attached to the housing;

e. a diaphragm ring connected to the diaphragm, the diaphragm ring having a body defined by an outer perimeter and at least a first inner perimeter and a second inner perimeter adjacent the first inner perimeter;

f. wherein the first inner perimeter is adjacent to a top surface of the diaphragm ring and wherein the diaphragm is attached to the top surface of the diaphragm ring;

g. wherein the second inner perimeter is adjacent to the bottom surface of the diaphragm ring;

h. wherein the second inner perimeter is smaller than the first inner perimeter.

2. The microphone of claim 1 wherein the diaphragm ring is integrally formed.

3. The microphone of claim 1 wherein the first inner perimeter and the second perimeter are provided by two separate diaphragm ring portions which form the diaphragm ring.

4. The microphone of claim 1 wherein a difference between the first inner perimeter and the second inner perimeter provides a stepped portion of the diaphragm ring.

5. The microphone of claim 1 wherein a space exists between the second inner perimeter and the diaphragm.

6. The microphone of claim 1 wherein a taper exists between the top surface and the bottom surface.

* * * * *